US005967247A

United States Patent [19]

Pessier

[11] Patent Number: 5,967,247

[45] Date of Patent: Oct. 19, 1999

[54] STEERABLE ROTARY DRAG BIT WITH LONGITUDINALLY VARIABLE GAGE AGGRESSIVENESS

[75] Inventor: Rudolf C. O. Pessier, Houston, Tex.

[73] Assignee: Baker Hughes Incorporated, Houston, Tex.

[21] Appl. No.: 08/925,227

[22] Filed: Sep. 8, 1997

[51] Int. Cl.[6] ..... E21B 10/50

[52] U.S. Cl. ..... 175/408; 175/415; 175/406

[58] Field of Search ..... 175/331, 371, 175/378, 408, 415, 405.1, 406, 417

[56] References Cited

U.S. PATENT DOCUMENTS

| | | | |
|---|---|---|---|
| 4,429,755 | 2/1984 | Williamson . | |
| 4,499,958 | 2/1985 | Radtke et al. . | |
| 4,515,226 | 5/1985 | Mengel et al. . | |
| 4,545,441 | 10/1985 | Williamson . | |
| 5,004,057 | 4/1991 | Tibbitts et al. . | |
| 5,163,524 | 11/1992 | Newton, Jr. et al. | 175/408 |

FOREIGN PATENT DOCUMENTS

| | | |
|---|---|---|
| 2 294 071 | 4/1996 | United Kingdom . |

*Primary Examiner*—William Neuder
*Assistant Examiner*—Zakiya Walker
*Attorney, Agent, or Firm*—Trask, Britt & Rossa

[57] ABSTRACT

A rotary drag bit including a gage design which facilitates steerability while preventing lateral displacement of the bit and attendant ledging of the borehole wall, and reams and conditions the borehole wall as the bit advances through the formation. The bit includes an elongated gage section comprised of a plurality of circumferentially spaced gage pads, each including mutually longitudinally displaced gage pad segments of varying lateral aggressiveness, or tendency to cut formation material under application of load. A leading gage pad segment extending from and closest to the bit face is somewhat aggressive, being provided with conventional PDC cutting elements, while an intermediate gage pad segment is devoid of cutters and may be characterized as a "slick" gage segment, acting as a bearing surface and limiting lateral displacement of the bit under pure side loads, and a trailing, tapered gage pad segment is somewhat aggressive, being provided with cutting elements to ream and condition the borehole wall.

21 Claims, 3 Drawing Sheets

STEERABLE ROTARY DRAG BIT WITH LONGITUDINALLY VARIABLE GAGE AGGRESSIVENESS

BACKGROUND OF THE INVENTION

1. Field of the Invention

The present invention relates generally to rotary drill bits for drilling subterranean formations, and, more specifically, to rotary drag bits employing superabrasive cutting elements and employing longitudinally separated gage areas exhibiting varying aggressiveness with regard to side cutting a formation being drilled, so as to be easily steerable under combined axial and side loading while facilitating a smooth, ledge-free borehole wall in both linear and non-linear drilling.

2. State of the Art

It has long been known to design the path of a subterranean borehole to be other than linear in one or more segments, and so-called "directional" drilling has been practiced for many decades. Variations of directional drilling include drilling of a horizontal, or highly deviated, borehole from a primary, substantially vertical borehole, and drilling of a borehole so as to extend along the plane of a hydrocarbon-producing formation for an extended interval, rather than merely transversely penetrating its relatively small width or depth. Directional drilling, that is to say varying the path of a borehole from a first direction to a second, may be carried out along a relatively small radius of curvature as short as five to six meters, or over a radius of curvature of many hundreds of meters.

Perhaps the most sophisticated evolution of directional drilling is the practice of so-called navigational drilling, wherein a drill bit is literally steered to drill one or more linear and non-linear borehole segments as it progresses using the same bottomhole assembly and without tripping the drill string.

Positive displacement (Moineau) type motors as well as turbines have been employed in combination with deflection devices such as bent housing, bent subs, eccentric stabilizers, and combinations thereof to effect oriented, nonlinear drilling when the bit is rotated only by the motor drive shaft, and linear drilling when the bit is rotated by the superimposed rotation of the motor shaft and the drill string.

Other steerable bottomhole assemblies are known, including those wherein deflection or orientation of the drill string may be altered by selective lateral extension and retraction of one or more contact pads or members against the borehole wall. One such system is the AutoTrak™ system, developed by the INTEQ operating unit of Baker Hughes Incorporated, assignee of the present invention. The bottomhole assembly (BHA) of the AutoTrak™ system employs a non-rotating sleeve through which a rotating drive shaft extends to drive a rotary bit, the sleeve thus being decoupled from drill string rotation. The sleeve carries individually controllable, expandable, circumferentially spaced steering ribs on its exterior, the lateral forces exerted by the ribs on the sleeve being controlled by pistons operated by hydraulic fluid contained within a reservoir located within the sleeve. Closed loop electronics measure the relative position of the sleeve and substantially continuously adjust the position of each steering rib so as to provide a steady side force at the bit in a desired direction.

In any case, those skilled in the art have designed rotary bits, and specifically rotary drag, or fixed cutter bits, to facilitate and enhance "steerable" characteristics of bits, as opposed to conventional bit designs wherein departure from a straight, intended path, commonly termed "walk", is to be avoided. Examples of steerable bit designs are disclosed and claimed in U.S. Pat. No. 5,004,057 to Tibbitts, assigned to the assignee of the present invention.

It has been found that elongated gage pads exhibiting relatively low aggressiveness, or the tendency to engage and cut the formation, are beneficial for directional or steerable bits, since they tend to prevent sudden, large, lateral displacements of the bit, which displacements may result in so-called "ledging" of the borehole wall. A better quality borehole and borehole wall surface in terms of roundness, longitudinal continuity and smoothness is created, which allows for smoother transfer of weight from the surface of the earth through the drill string to the bit, as well as better tool face control, which is critical for monitoring and following a design path by the actual borehole as drilled.

This design approach exhibits shortcomings, however, if the available drilling system is only able to provide relatively low side loads, as is the case in otherwise highly sophisticated state-of-the-art steerable bottomhole assemblies relying upon integrally-powered active deflection elements rather than applied weight acting on the bit through a drill string including one of the aforementioned deflecting devices. "Relatively low" side loads include loads that are not sufficient to generate high enough contact stresses to fail the borehole wall material. In such a situation, the elongated gage pads limit the side cutting ability of the bit, and thus inhibit the ability of the bit to drill a non-linear path.

The conventional bit design approach responsive to limited side loads is to employ short or tapered gage pads to enhance the steerability of the bit. This approach, however, demonstrably lacks the directional stabilization and beneficial borehole condition-enhancing characteristics of the previously-described, elongated, non-aggressive gage pads.

Thus, there is a need in the directional drilling art for a steerable drill bit which provides good directional stability as well as steerability, precludes lateral bit displacement, and maintains borehole quality, all under relatively low side loads.

BRIEF SUMMARY OF THE INVENTION

The present invention comprises a rotary drag bit having a relatively long gage exhibiting varying degrees of aggressiveness at longitudinally separate locations along the gage.

The bit includes a gage comprised of a plurality of circumferentially spaced gage pads separated by intervening, longitudinally extending junk slots, each of the gage pads being comprised of a plurality of longitudinally separate pad segments, each segment of a pad having a different degree of aggressiveness than at least one longitudinally adjacent segment of the same pad.

In one embodiment, the leading pad segment of each pad bears superabrasive cutters, such as conventional disc-shaped polycrystalline diamond compact (PDC) cutters comprised of a diamond table mounted to a supporting tungsten carbide (WC) substrate, immediately adjacent the bit face. These cutters may, in fact, be contiguous with and extend without perceptible longitudinal separation from PDC cutters mounted on the face of the bit. Thus, the leading gage segments will cut the formation under combined axial and side loads on the bit, assisting the bit in turning to a new orientation to drill ahead in a new direction. Behind and above leading pad segments (such terms being used with reference to the direction of bit travel), intermediate gage segments are configured as "slick" or cutter devoid, longitudinally extending arcuate surfaces. The intermediate gage pad segments prevent lateral displacement of the bit under pure side loads, their cutter devoid surfaces acting as bearing areas to prevent ledging of the borehole wall. Behind and above intermediate segments are placed trailing gage pad segments carrying superabrasive cutters to ream and condition (smooth) the borehole wall, facilitating smoother application of weight to the bit and better tool face control by markedly reducing the tendency of the BHA to alternately slip and stick, both longitudinally and rotationally, in the borehole. The trailing segments may be tapered radially inwardly as the distance from the bit face increases, if desired, to ensure a smooth borehole wall as the bit travels along an arcuate path while drilling a nonlinear borehole segment.

DETAILED DESCRIPTION OF THE INVENTION

Figure 1:
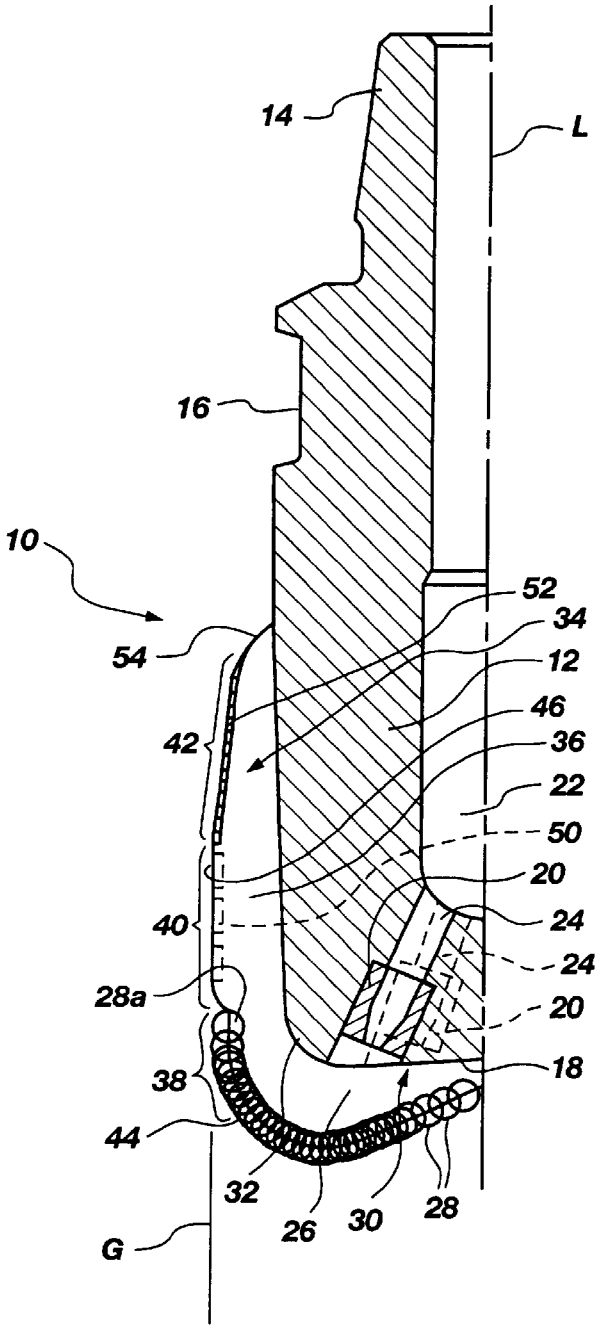
FIG. 1 comprises a quarter-section side elevation of a steerable drill bit according to the present invention.
Figure 2:
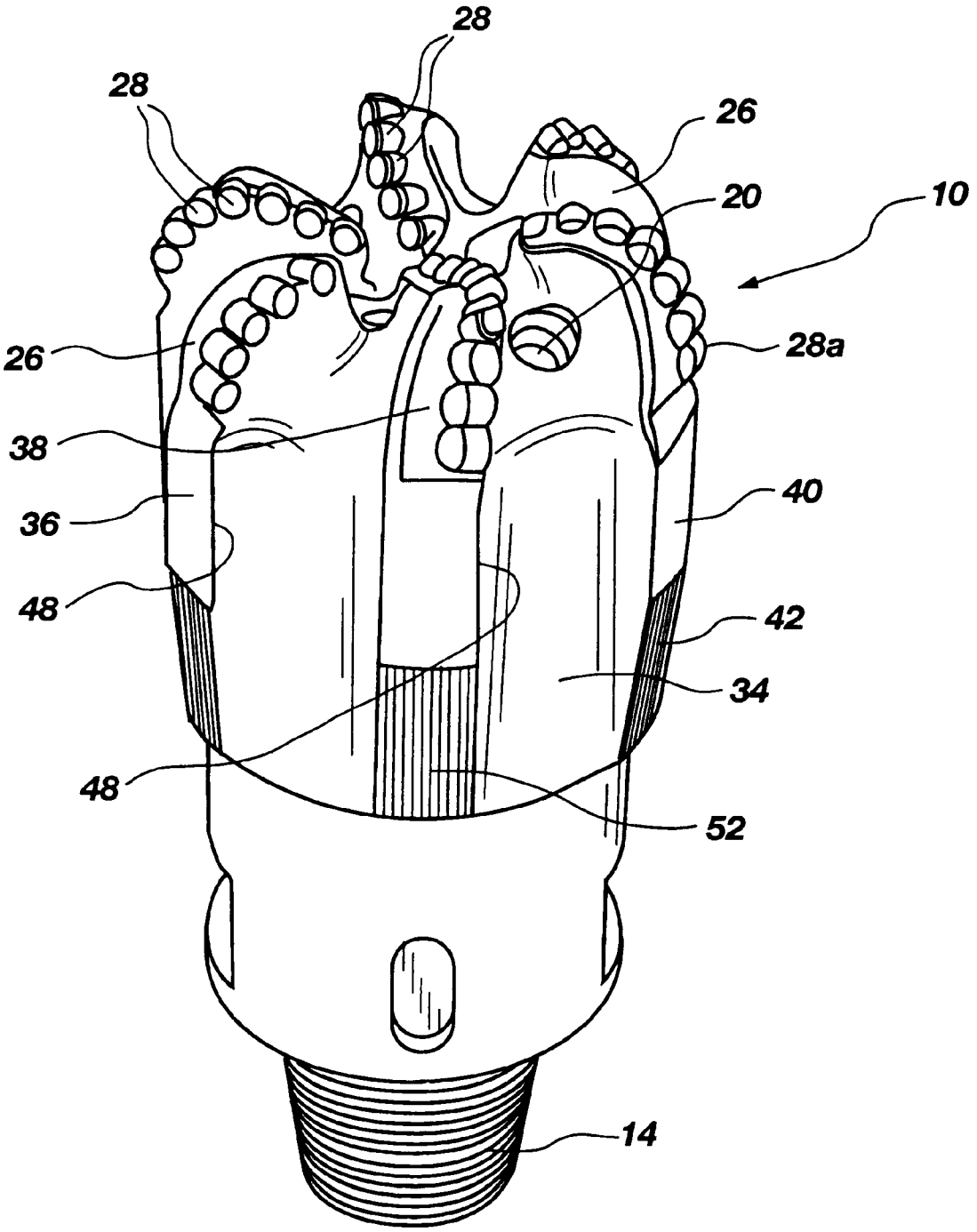
FIG. 2 comprises a perspective view of a steerable bit according to the invention, inverted from its normal drilling orientation.

Referring now to FIGS. 1 and 2, drill bit 10 of the present invention includes a bit body 12 topped by a threaded pin connection 14 for securing bit 10 to the end of a drill string. Flats 16 are employed for making up bit 10 to the end of the string. Usually, bit 10 will be made up to the output or drive shaft of a downhole motor, or to a shaft extending through a steerable assembly, if no motor is employed and the bit is rotated only by drill string rotation.

Bit body 12 includes a face 18, onto which a plurality of nozzles 20 open to dispense drilling fluid received from plenum 22 through passages 24 in the form of high pressure fluid jets into the space between the bit face 18 and the formation being drilled. Bit 10 is a so-called "blade type" bit, wherein a plurality of blades 26 (six, in this instance) extends longitudinally from the bit body over the bit face 18, blades 26 carrying a plurality of superabrasive cutters 28 to engage the formation. The number of blades on a blade-type bit typically varies between three and eight, depending on the target formation type, required bit hydraulics, number of cutters and size (diameter) of the bit. The number and arrangement of blades being immaterial to the present invention, no further description thereof will be made.

Superabrasive cutters 28 comprise conventional, disc-shaped PDCs in bit 10 as illustrated, although other PDC shapes as well as other types of cutting elements such as thermally stable PDCs or natural diamonds may be employed in harder formations. As shown in FIG. 1, wherein radial placement of all cutters 28 is illustrated in superimposition to a single blade 26, there is at least one cutter 28 at each radial position from the longitudinally extending center line L of bit 10, to and including the gage G. Also as shown, there are relatively more cutters 28 at a given radius (distributed among several blades) toward the gage G than toward the centerline L, as known in the art. Waterways 30 lie between blades 26, extending to the shoulder 32 of the bit body 12, where they communicate with junk slots 34. Junk slots 34 lie between circumferentially adjacent gage pads 36, which in bit 10 comprise extensions of blades 26, although such a design is not a requirement of the invention. Gage pads 36 each comprise three longitudinally separated segments 38, 40 and 42.

Figure 3A:
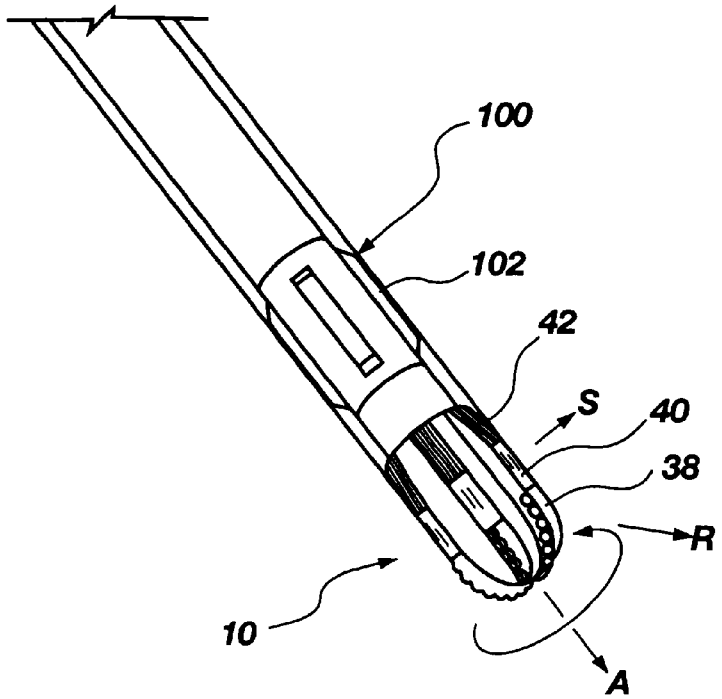
FIG. 3A comprises a schematic of a drill bit according to the present invention in the process of turning to a new course under combined axial and side loading.

Leading, or first, segment 38 of each gage pad 36 actually begins at the shoulder 44 of blade 26, wherein cutters 28 transition from cutting the bottom of the borehole to the side of the borehole. Some of the cutters 28*a* may have preformed, longitudinally oriented flats thereon to precisely define the gage diameter drilled by bit 10, although such cutters 28*a* are not required. Leading segment 38 assists bit 10 in turning or following a non-linear path while drilling borehole 100 as illustrated in FIG.3A, under combined axial loading A and oriented side or lateral loading S, the cutters 28 and 28*a* engaging the formation in both a forward and side-cutting action under the oblique resultant load R on bit 10. However, lateral displacement of bit 10 under side loading S is precluded by intermediate segment 40, as subsequently described.

Figure 3B:
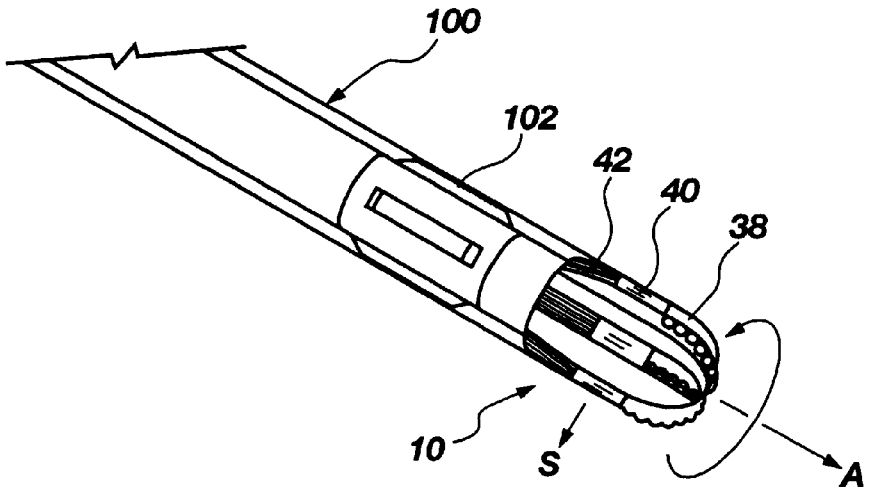
FIG. 3B comprises a schematic of the drill bit of FIG. 3A drilling a straight segment of borehole in an inclined orientation.

Intermediate, or second, segment 40 of each gage pad 36 exhibits a markedly different structure in the form of longitudinally extending, cutting structure devoid, arcuate surface 46, which defines an outer radius slightly smaller than that cut in the formation by cutters 28 and 28*a* of leading segment 38. The rotationally leading edges 48 (FIG. 2) of segments 40 are rounded so as to preclude any tendency to engage the formation, and the arcuate surfaces 46 of the plurality of segments 40 provide, in combination, a bearing surface upon which the bit 10 may rotate against the sidewall 102 of the borehole 100 under pure side or lateral loads without lateral displacement, as shown in both FIG. 3A and FIG. 3B. Such circumstances may even occur when, for example, bit 10 is drilling straight ahead, but is oriented at an inclination to the vertical (FIG. 3B), or even when drilling horizontally. Thus, the presence of segments 40 limits the degree to which the cutters 28 and 28*a* of segments 38 can engage and penetrate the borehole sidewall 102 under pure or greatly predominant side loading S, preventing lateral displacement of bit 10 with the borehole sidewall ledging attendant to such displacement. Stated another way, intermediate segments 40 act as penetration limiters with respect to cutters 28 and 28*a* of segments 38. Arcuate surfaces 46 may be formed of a wear resistant material such as WC, diamond grit filled WC, or a ceramic. Alternatively, arcuate surfaces 46 may be provided with wear-resistant inserts 50, comprising bricks, discs or other elements of suitable wear resistant materials. The need for such wear-resistance is, of course, dependent upon the abrasiveness and length of the formation interval being drilled. Finally, it is contemplated that segments 40 may include material such as WC carrying unexposed (i.e., flush with the arcuate surface 46) natural diamonds or thermally stable PDC elements for enhanced wear resistance. However, surface wear of the material in which such natural diamonds or PDCs are embedded may eventually, over a long drilling interval, expose these and thus result in an undesired cutting action. Hence, this alternative structure is currently less preferred.

Figure 1A:
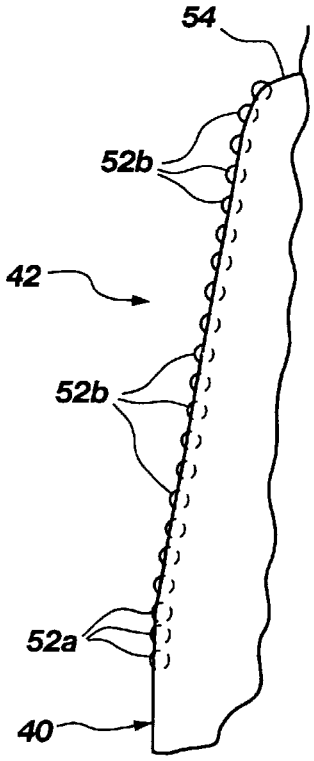
FIG. 1A comprises an enlarged side elevation of a trailing gage pad segment including cutters of increasing radial exposure toward a trailing end of the segment.

Trailing, or third, segments 42 of gage pads 36, like leading segments 38, bear superabrasive cutters 52. Cutters 52 may comprise PDCs, thermally stable PDCs, natural diamonds, or a combination thereof. As depicted in FIG. 2, the cutters 52 comprise exposed natural diamonds. The radius defined by the laterally outermost edges of cutters 52 of an adjacent intermediate segment 40 may be substantially the same as that defined by the cutters 28*a* of leading segment 38, while the remainder of trailing segment 42 tapers to a smaller radius as it approaches trailing end 54 of gage pad 36. It may be desirable to set cutters 52*a* in the portions of segments 42 longitudinally adjacent intermediate segments 40 substantially flush or only slightly exposed, and to increase exposure of cutters 52*b* carried by portions of segments 42 increasingly more longitudinally distant from segments 40 and the bit face 18, and closer to trailing ends 54. Such an arrangement is shown in FIG. 1A The presence of cutters 52 conditions and smooths the borehole side wall as bit 10 advances, particularly enhancing the quality of the borehole side wall as the bit drills a nonlinear path. Thus, other components of the bottomhole assembly and the drill collars and drill pipe thereabove following bit 10 have a reduced tendency to hang up on ledges in the borehole wall. Further, weight may be applied to bit 10 more smoothly and without the danger of momentary drill string sticking against the borehole wall, followed by overweighting of the bit and possible cutter damage and stalling (if a downhole motor is employed). Thus, tool face is more readily maintained, reducing the possibility of costly interruptions in the drilling process while the driller has to pull the string off the borehole bottom to reestablish a new reference point before drilling can resume.

While the present invention has been described in the context of the embodiment illustrated herein, those of ordinary skill in the art will recognize and appreciate that it is not so limited. For example, the lengths and aggressivity of the various gage segments may be adjusted to accommodate particular formation types, as well as the type of nonlinear drilling contemplated to be effected using the bit. For example, for short-radius directional drilling, wherein the drill string turns about a radius of less than about six meters, leading and trailing segments 38 and 42 may be made short and extremely aggressive, and intermediate segment 40 relatively short, so as to not inhibit the ability of the bit to turn sharply. In contrast, when medium (about forty to two hundred meters turning radius) and long (over about three hundred meters) radius drilling is contemplated, all segments 38, 40 and 42 may be more elongated, and the aggressiveness of leading and trailing segments 38 and 42 reduced. Another variable is the degree or amount of radial recess of the arcuate surface 46 of intermediate, smooth segments 40, with respect to the radius defined by the cutters carried by segments 38 and 42, the magnitude of which recess may be selected to range from a minimum (substantially flush) to a depth which permits a more substantial depth of cut of cutters carried by segments 38 and 42 while still preserving the function of segments 40 as a bearing surface. As noted above, cutter type and density may be varied according to the formation, and cutter types mixed where desirable. The invention may be practiced with non-bladed bits and bits with other profiles, again dependent upon the formation characteristics. Approaches in varying cutter type, placement and density as well as bit configurations responsive to formation characteristics are known in the art, and so will not be further described herein.

What is claimed is:

1. A rotary drag bit, for drilling a subterranean formation, comprising:

a bit body extending along a longitudinally extending centerline, having a face and a structure secured thereto for connecting the rotary drag bit to a drill string;

a plurality of cutters disposed over the bit face to cut the formation between the longitudinally extending centerline and a shoulder area at a radially outermost periphery of the face;

a plurality of gage pads circumferentially disposed about the bit body, commencing at the shoulder area and extending longitudinally away from the face, at least some of the gage pads of the plurality of gage pads each including:

a first segment extending from the shoulder area radially outwardly and longitudinally away from the face, and bearing a plurality of cutters which, at a maximum radial extent, define a gage diameter for the bit;

a second segment longitudinally adjacent the first segment, the second segment being substantially devoid of exposed cutters and comprising a longitudinally-extending arcuate surface; and a third segment longitudinally adjacent the second segment and bearing a plurality of cutters.

2. The rotary drag bit of claim 1, wherein the face cutters are disposed on blades extending from the bit body over the face.

3. The rotary drag bit of claim 2, wherein the gage pads comprise extensions of the blades.

4. The rotary drag bit of claim 2, wherein the gage pads are circumferentially aligned with the blades.

5. The rotary drag bit of claim 1, wherein the face cutters comprise superabrasive cutters.

6. The rotary drag bit of claim 1, wherein the first and third segment cutters comprise superabrasive cutters.

7. The rotary drag bit of claim 1, wherein the first segment cutters comprise substantially disc-shaped PDC cutters, and the first segment PDC cutters defining the gage diameter of the bit include preformed flats thereon defining the gage diameter.

8. The rotary drag bit of claim 1, wherein the third segment cutters comprise natural diamonds, at least some of which third segment cutters are exposed.

9. The rotary drag bit of claim 1, wherein the third segment longitudinally tapers from a larger to a smaller radius from the longitudinal axis as it extends away from the bit face.

10. The rotary drag bit of claim 1, wherein at least some third segment cutters increase in exposure as the third segment extends longitudinally away from the bit face.

11. The rotary drag bit of claim 1, wherein a leading lateral edge of the second segment, taken in a direction of bit rotation, is rounded.

12. The rotary drag bit of claim 1, wherein the first, second and third segments of the at least some of the gage pads of the plurality of gage pads are sequentially longitudinally contiguous.

13. The rotary drag bit of claim 1, wherein the arcuate surface of the second segment defines a radius smaller than a radius defined by cutters of at least one of the first and third segments.

14. The rotary drag bit of claim 13, wherein the arcuate surface of the second segment is radially recessed with respect to the cutters of both the first and third segments.

15. The rotary drag bit of claim 1, wherein the arcuate surface of the second segment is substantially radially flush with an outermost radius defined by cutters of the first and third segments.

16. The rotary drill bit of claim 1, wherein third segment cutters longitudinally closest to the second segment are set substantially flush with a radially outer surface of the third segment.

17. The rotary drill bit of claim 1, wherein exposure in a radial direction of third segment cutters increases with longitudinal distance from the bit face.

18. The rotary drill bit of claim 1, wherein at least some of the third segment cutters define a radius substantially the same as the gage diameter of the bit.

19. The rotary drill bit of claim 1, wherein the second segment includes at least one element of a wear-resistant material comprising at least a portion of the arcuate surface thereof.

20. The rotary drill bit of claim 1, wherein the arcuate surface of the second segment is comprised at least in part of a wear-resistant material.

21. The rotary drill bit of claim 1, wherein the second segment is oriented and configured to limit lateral penetration of at least some first and third segment cutters into the subterranean formation.

* * * * *

UNITED STATES PATENT AND TRADEMARK OFFICE

CERTIFICATE OF CORRECTION

PATENT NO. : 5,967,247
DATED : October 19, 1999
INVENTOR(S) : Rudolf C. O. Pessier It is certified that error appears in the above-identified patent and that said Letters Patent is hereby corrected as shown below:

Column 1,
Line 9, after "formations" delete ","
Line 65, after "drag" delete ","

Column 4,
Line 1, change "center line" to -- centerline --
Line 20, change "FIG.3A" to -- FIG. 3A --

Column 5,
Line 14, after "FIG 1A" insert -- . --
Line 28, change "reestablish" to -- re-establish --
Line 35, change "nonlinear" to -- non-linear --

Column 6,
Line 19, after "and" insert a hard return
Line 20, start line as an indented subparagraph aligned with subparagraph directly above it beginning with "a third segment"
Line 43, change "longitudinal axis" to -- longitudinally extending centerline --
Line 66, change "drill" to -- drag --
Line 66, after "wherein" insert -- the --

Column 7,
Lines 1, 4 and 7, change "drill" to -- drag --
Line 2, after "of" insert -- the --

Column 8,
Lines 1 and 4, change "drill" to -- drag --

Signed and Sealed this

Ninth Day of September, 2003

JAMES E. ROGAN
*Director of the United States Patent and Trademark Office*